US005170649A

United States Patent [19]

Lonati

[11] Patent Number: 5,170,649

[45] Date of Patent: Dec. 15, 1992

[54] CIRCULAR KNITTING MACHINE FOR SOCKS, STOCKINGS OR THE LIKE, IN PARTICULAR FOR PRODUCING KNITTING WITH TOWELLING STITCHES

[75] Inventor: Francesco Lonati, Brescia, Italy

[73] Assignee: Lonati S.r.l., Brescia, Italy

[21] Appl. No.: 723,115

[22] Filed: Jun. 28, 1991

[30] Foreign Application Priority Data

Jul. 13, 1990 [IT] Italy ..... 20928 A/90

[51] Int. Cl.[5] ..... D04B 9/20; D04B 15/32

[52] U.S. Cl. ..... 66/217; 66/9 R

[58] Field of Search ..... 66/8, 9 R, 14, 104, 66/106, 194, 217

[56] References Cited

U.S. PATENT DOCUMENTS

| | | | |
|---|---|---|---|
| 2,134,480 | 10/1938 | Houseman | 66/217 |
| 4,519,221 | 5/1985 | Hirano | 66/217 X |
| 4,633,683 | 1/1987 | Schmidt | 66/194 X |
| 4,718,254 | 1/1988 | Lonati | 66/14 |

FOREIGN PATENT DOCUMENTS

| | | | |
|---|---|---|---|
| 3725151 | 2/1988 | Fed. Rep. of Germany . | |
| 1280056 | 12/1986 | U.S.S.R. | 66/194 |
| 1229047 | 4/1971 | United Kingdom . | |
| 2062019 | 5/1981 | United Kingdom . | |
| 2144154 | 2/1985 | United Kingdom . | |

*Primary Examiner*—Werner H. Schroeder
*Assistant Examiner*—John J. Calvert
*Attorney, Agent, or Firm*—Guido Modiano; Albert Josif

[57] ABSTRACT

The circular knitting machine for socks, stockings or the like, in particular for producing knitting with towelling stitches, comprises, at the set of knitting-forming cams which actuate the motion of the needles during the engagement of the thread or threads at one feed of the machine, an additional cam. The additional cam is arranged above the central cam and defines a descending portion which is engageable with the heel of the needles, excluded from knitting at that feed and raised with respect to the needles which knit at that feed. The controlled lowering of the needles which do not knit at the feed facilitates the positioning of the thread or threads fed at the feed and the correct forming of the loops by the needles which knit at that feed.

13 Claims, 3 Drawing Sheets

CIRCULAR KNITTING MACHINE FOR SOCKS, STOCKINGS OR THE LIKE, IN PARTICULAR FOR PRODUCING KNITTING WITH TOWELLING STITCHES

BACKGROUND OF THE INVENTION

The present invention relates to a circular knitting machine for socks, stockings or the like, in particular for producing knitting with towelling stitches.

As known, in circular knitting machines loop pile stitches are formed by using casting-off sinkers which have two casting-off planes arranged at mutually different vertical levels and by feeding the needles with two threads at points arranged at mutually different vertical levels.

Upstream of the thread feed along the direction of rotation of the needle cylinder with respect to the needle actuation cams, the sinkers are moved, by means of actuation cams, toward the outside of the needle cylinder so as to release the loops formed by the needles and move the casting-off planes into the position for receiving the thread which is engaged by the needles. The subsequent lowering of the needles between the sinkers forms stitches, each of which is composed of two loops with mutually different lengths, i.e. so-called loop pile stitches.

In some situations, the stitches formed by the needles may be defective, since the two threads which compose the loop pile stitch do not rest correctly on the related casting-off plane but instead end on the same casting-off plane of the sinkers, causing the forming of two loops with identical lengths.

Knitting defects of this type occur more frequently in circular machines for very finely knitted socks or stockings during the knitting of the tip or heel thereof.

As known, when the knitting of the heel or tip of the sock or stocking begins, one half of the needles of the machine is in fact excluded from knitting, whereas the other half of the needles continue to form knitting at one feed of the machine.

The needles excluded from knitting are raised with respect to the other needles and are kept in this position until the heel or tip is completed.

The needle cylinder is actuated with an alternating rotary motion about the needle cylinder axis and at every forward or reverse stroke of the needle cylinder the first needle of the set of needles which has just knit at the feed being considered is raised and excluded from knitting in order to achieve the progressive casting off of stitches typical of the forming of the heel or tip. The needles excluded from knitting keep the last formed loop on their stem.

Knitting defects in the forming of loop pile stitches in this step can be mainly ascribed to the traction exerted on the fed threads by the loops carried by the needles excluded from knitting. During the forming of the heel or of the tip, the threads fed to the feed being considered are engaged with the last needle of the set of needles which does not knit at said feed and which is therefore raised with respect to the subsequent needle, which instead must engage the threads supplied by said feed. For this reason, both of the fed threads are subjected to an upward traction which prevents the thread fed at a lower level from resting on the lower casting-off plane of the sinkers and instead makes it rest on its upper casting-off plane together with the other thread. This traction is also increased due to the cast-offs, since the last needle of the set which does not knit at the feed being considered has been excluded from the knitting, and has thus been raised, directly upstream of said feed.

The upward traction effect, the force of which increases as the rigidity of the threads increases and as the fineness of the machine becomes greater, easily affects the entire row of knitting being formed, producing a defective row which can lead to the rejection of the manufactured sock or stocking.

SUMMARY OF THE INVENTION

The aim of the present invention is to solve the above described problem by providing a circular knitting machine for socks, stockings or the like which allows to produce knitting with loop pile stitches having no defects even with scarcely elastic threads.

Within the scope of this aim, an object of the invention is to provide a machine for manufacturing socks or stockings with very fine knitting, which is capable of performing loop pile stitch knitting having no defects even at the heel or toe position of the sock or stocking.

Another object of the invention is to provide a machine which can be obtained from known machines with modifications that are easily carried out.

A further object of the invention is to provide a machine which achieves high production rates while reducing knitting waste.

This aim, these objects and others which will become apparent hereinafter are achieved by a circular knitting machine for socks, stockings or the like, in particular for producing knitting with loop pile stitches, comprising a needle cylinder having a skirt and being activatable with a rotary motion about its own needle cylinder axis, a plurality of axial grooves defined on the outer surface of said skirt, each of said grooves slideably accommodating a needle, needle actuation cams facing said skirt of said needle cylinder and defining paths for heels of said needles which protrude radially from said grooves, a plurality of casting-off sinkers being provided, each casting-off sinker being arranged between two contiguous axial grooves of said needle cylinder, proximate to an upper end thereof, said sinkers being radially movable with respect to said needle cylinder to tension loops formed by said needles; said needle actuation cams comprising, upstream of at least one thread feed along the direction of rotation of the needle cylinder about said needle cylinder axis with respect to said needle actuation cams, at least one lifting cam for lifting the needles into a position suitable for gripping at least one thread fed by said thread feed and, successively to said lifting cam, a central cam defining a first descending portion for needles knitting at said feed, wherein immediately above said central cam there is an additional cam defining a descending portion engageable with heels of needles for controlled lowering of loops carried by the needles not knitting during said feed.

BRIEF DESCRIPTION OF THE DRAWINGS

Further characteristics and advantages of the invention will become apparent from the description of a preferred but not exclusive embodiment of the machine according to the invention, illustrated only by way of non-limitative example in the accompanying drawings, wherein.

DESCRIPTION OF THE PREFERRED EMBODIMENTS

Figure 1:
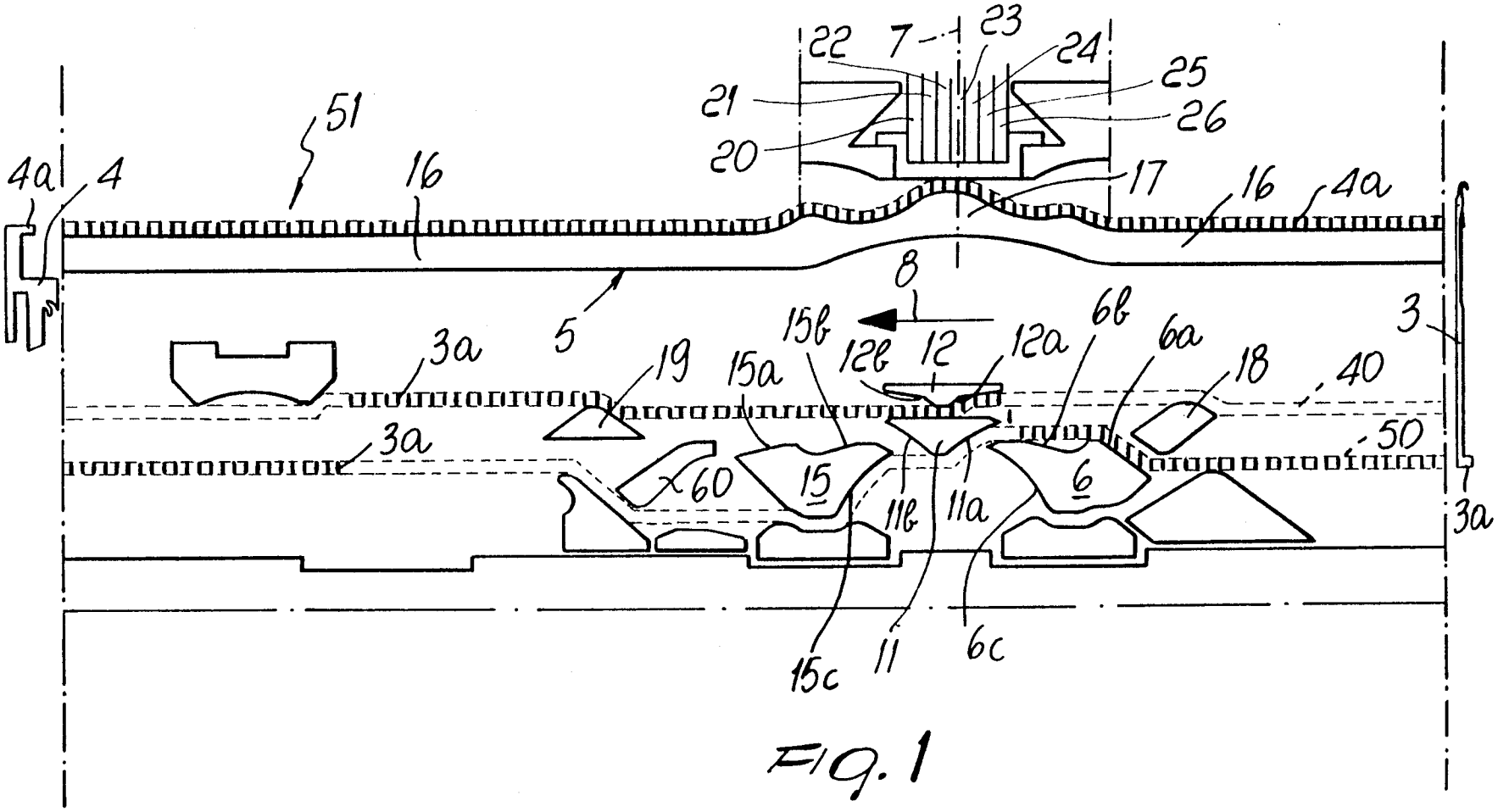
FIG. 1 is a schematic view, taken from the side of the needle cylinder, of the needle actuation cams and of the casting-off sinkers, developed on a plane, of the machine according to the invention, indicating the paths of the heels of the needles in the rotary motion of the needle cylinder, with respect to said cams, in one direction.

With reference to the above figures, the machine according to the invention comprises, in a known manner, a needle cylinder 1 which can be actuated with rotary motion about its own axis. The cylinder 1 is arranged vertically and has a plurality of axial grooves 2 in each of which a needle 3 is slideably accommodated.

The machine furthermore has, in a known manner, an annular body, not illustrated for the sake of simplicity, which is rigidly associated with the needle cylinder 1 around its upper end and has a plurality of radial grooves inside which the casting-off sinkers 4 are slidingly accommodated.

Each of the radial grooves, and accordingly each of the casting-off sinkers 4, is arranged between two contiguous axial grooves 2 of the needle cylinder 1.

The casting-off sinkers 4 are conveniently of the type with two casting-off planes **4*b* and 4*c* arranged at mutually different vertical levels to form loop pile stitches and have a protuberance 4*d*** for tensioning the formed knitting.

Needle actuation cams are arranged around the needle cylinder 1 and define paths for the heels **3*a* of the needles 3 which protrude radially from the grooves 2 formed in the skirt or annular surface of the needle cylinder so as to control the needles along the grooves 2** when the needle cylinder is actuated with a rotary motion about its own axis with respect to said cams.

A cam 5 with an annular extension is thus furthermore provided and is arranged around the needle cylinder 1, proximate to its upper end, so as to radially actuate the casting-off sinkers.

More particularly, the needle actuation cams comprise a set of knitting forming cams composed of a first lifting cam 6 arranged upstream of a feed 7 of the machine, along a direction of rotation of the needle cylinder indicated by the arrow 8 in FIG. 1.

Said first cam 6 defines, upstream of the feed 7 along the direction 8, two ascending portions **6*a* and 6*b* which are engageable by the heel 3*a* of the needles which must knit at said feed 7 to move the needles into a position suitable for engaging the fed threads 9 and 10**.

The knitting-forming cam set comprises a central cam 11 which is arranged at the feed 7 and defines a first descending portion **11*a* which can engage the heel 3*a* of the needles which have engaged the threads at the feed 7**.

The needles excluded from knitting at the feed 7, for example during the forming of the heel or of the tip of a sock or stocking, pass with their heel above the central cam 11.

According to the invention, above the central cam 11 there is an additional cam 12 which defines a descending portion **12*a* which can engage the heel of the needles excluded from knitting at the feed 7 so as to achieve a controlled lowering of the loops 13 carried by the needles excluded from knitting during the feed of the threads to the needles which knit at said feed 7**.

Figure 2:
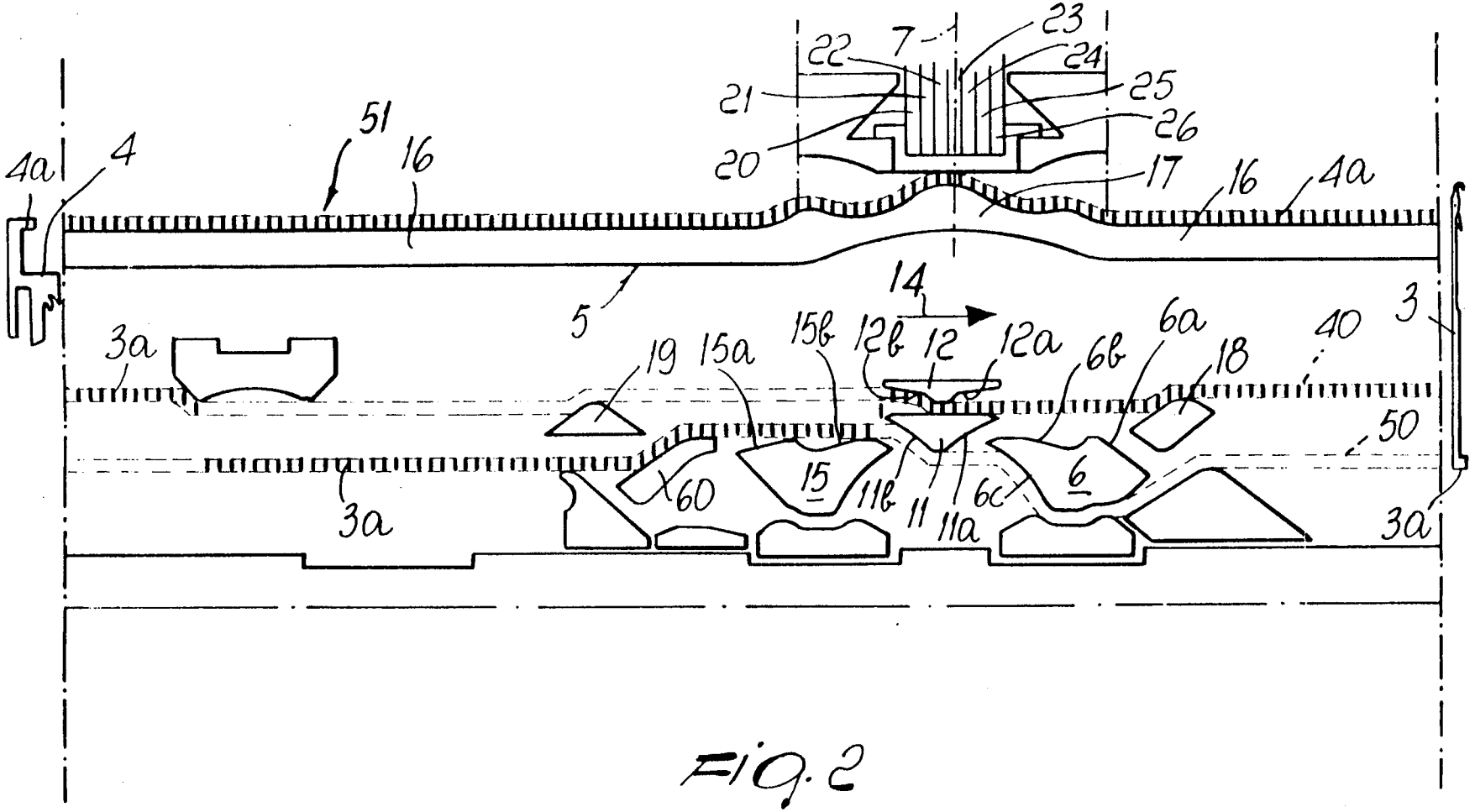
FIG. 2 is a view, taken similarly to FIG. 1, which indicates the paths of the needle heels in the rotary motion of the needle cylinder, with respect to said cams, in the opposite direction.

Said additional cam 12 furthermore defines a further descending portion **12*b* which is substantially symmetrical with respect to the feed 7 of the portion 12*a* and is engageable with the heel 3*a* of the needles excluded from knitting when the needle cylinder is actuated with a rotary motion in the direction opposite to the one indicated by the arrow 8 in FIG. 1, i.e. in the direction indicated by the arrow 14 in FIG. 2**.

Thus the central cam 11 also defines a further first descending portion **11*b* for the needles which knit at the feed 7 with the needle cylinder actuated with rotary motion in the direction 14. Said descending portion 11*b* is substantially symmetrical to the portion 11*a* with respect to the feed 7**.

The descent of the needles which have engaged the threads at the feed 7, with the needle cylinder actuated along the direction of rotation 14, is completed by a descending portion **6*c* defined by the cam 6**.

The knitting-forming cam set is completed by a cam 15 which is substantially symmetrical to the cam 6 with respect to the feed 7. Said cam 15 in fact has two ascending portions **15*a* and 15*b*, for lifting the needles which must knit at the feed 7 when the needle cylinder rotates in the direction 14, and a descending portion 15*c* for the needles which have engaged the threads at the feed 7 when the needle cylinder rotates in the direction 8. In some cases, such as the illustrated one, a cam 60 which raises the needles upstream of the cam 15** may be provided.

The sinker actuation cam 5 defines a path for the heel **4*a* of the sinkers 4. Said path has, in a known manner, a portion 16 which is proximate to the needle cylinder axis upstream and downstream of the feed 7 and a portion 17 which is spaced from the needle cylinder axis at the feed 7**.

In this manner, the protuberances **4*d* of the sinkers 4 engage the loops formed around the stem of the needles when their heel follows the portion 16 to tense said loops in the direction of the needle cylinder axis, whereas the protuberance 4*d* is disengaged from the loops when their heel 4*a* follows the portion 17**.

Advantageously, the needle actuation cams furthermore comprise a lifting cam 18 which is engageable with the heel of the needles excluded from knitting at the feed 7. Said lifting cam 18 is arranged upstream of the cam 6 along the direction of rotation 8 of the needle cylinder and at the portion 16 defined by the sinker actuation cam 5.

Upstream of the cam 15 along the direction of rotation 14 of the needle cylinder there is also a lifting cam 19 which corresponds to the cam 18. Both in the rotation direction 8 and in the reverse direction 14, the lifting cams 18 and 19 engage the heel of the needles excluded from knitting at the feed 7 to cause their controlled lifting.

A plurality of thread guides, indicated by the reference numerals 20 to 26, is provided at the feed 7; the central one 23 of said thread guides preferably feeds the thread 9 which is intended to rest on the lower casting-off plane **4*b***.

The operation of the machine according to the invention is now described with reference to the production of a row of knitting with loop pile stitches during the knitting of the heel or tip of a sock or stocking.

For the sake of greater clarity, in FIGS. 3 to 6 the letters A, B, C, D, E indicate contiguous needles, of which: the needles A and B are excluded from knitting at the feed 7, the needle C is excluded from knitting just before reaching the feed 7 and the needles D, E knit at the feed 7.

FIGS. 1 and 2 instead show in broken lines, and indicate with the reference numerals 40 and 50, the paths of the heels of the needles which are respectively excluded from knitting and active at the feed 7 in the two directions of rotation of the needle cylinder; the reference numeral 51 equally indicates the path followed by the sinker heel along the cam 5.

With particular reference to FIG. 1, during the rotation of the needle cylinder in the direction 8, the needles excluded from knitting, before reaching the feed 7, are lifted by the cam 18, whereas the loops carried by said needles are tensioned on their stem by the sinkers 4 in the direction of the needle cylinder axis. In this manner said loops do not follow the needles in their ascent.

Subsequently, by encountering the additional cam 12, the needles excluded from knitting are lowered, whereas the sinkers 4 do not tense the loops on said needles. In this manner, the lowering of these needles achieves, by traction, the lowering of the loops on their stem.

In particular, the loops carried by the last needles excluded from knitting at the feed 7 undergo this lowering, thus avoiding the upward traction effect which can be observed in known machines and is performed by said loops on the threads 9 and 10 fed to the first needles which must knit at the feed 7 and which, in the meantime, have been lifted into a position suitable for engaging the threads.

Figure 3:
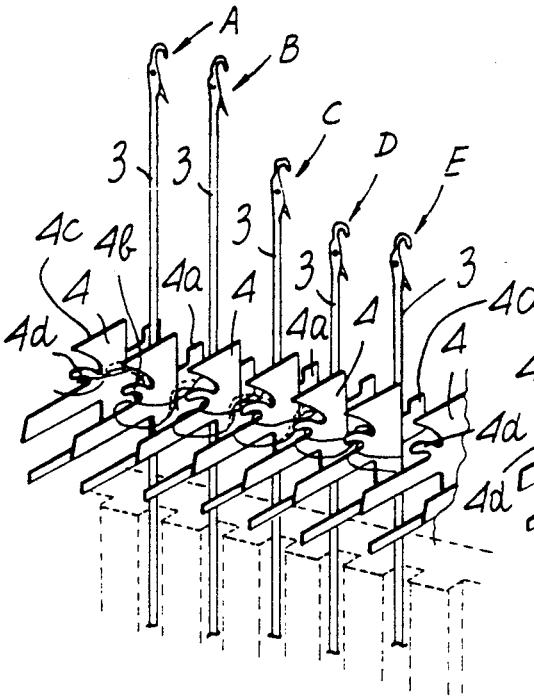
FIGS. 3 to 6 are schematic perspective views of the position of some needles and casting-off sinkers developed on a plane, during their passage proximate to a feed of the machine.
Figure 4:
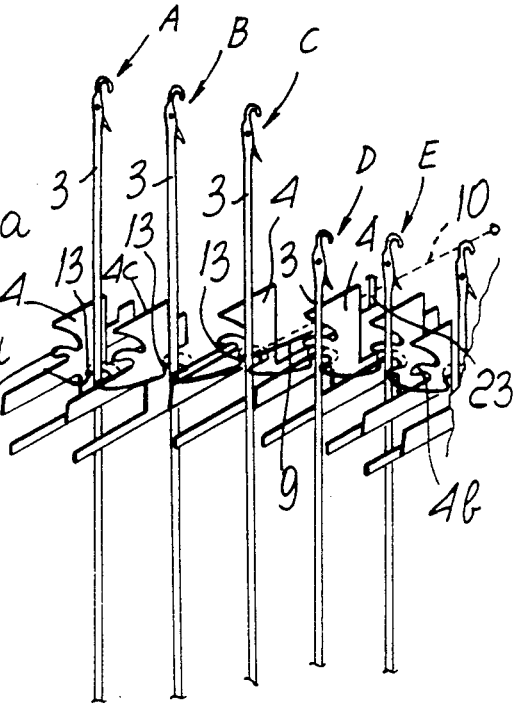
Figure 5:
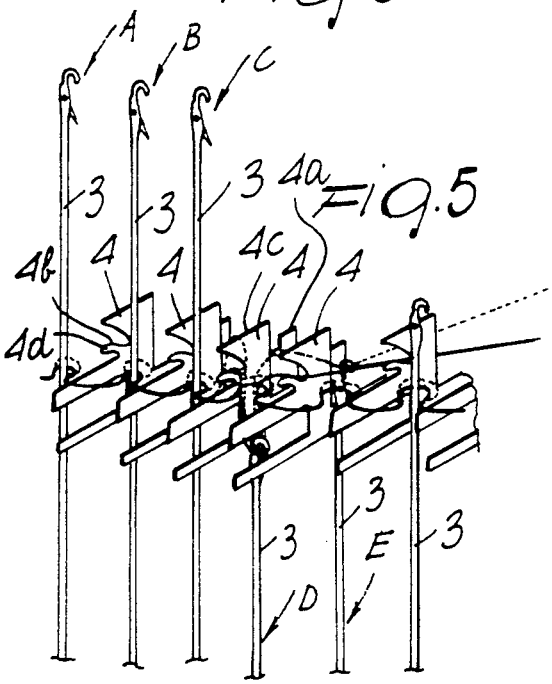
Figure 6:
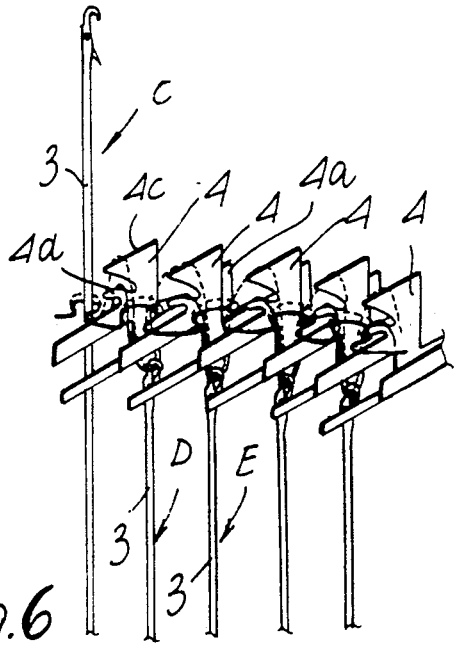

The lowering of the needles excluded from knitting at the feed 7 is shown in FIGS. 3 and 4, wherein the needles A and B undergo said lowering, whereas the needle C is excluded from the knitting or raised to the same level as the needles A and B to perform a so-called "narrowing". It should be noted that the needle C, which is excluded from knitting, is not raised to the level occupied by the needles A and B upstream of the additional cam 12 but only to the level occupied by the needles A and B after they have been lowered by the cam 12. The additional cam 12 is arranged immediately above the central cam 11 whereby the descending portion 12*a* is engageable with the heels of needles 3*a*, C not knitting, for controlled lowering of the loops 13 during feeding of the thread to the needles which knit at the feed 7. The needles not knitting are subjected to a controlled lifting in a position upstream of said feed along the direction of rotation of the needle cylinder while loops carried by the needles not knitting are engaged with casting-off sinkers.

This reduced raise of the needle C, which is excluded from the knitting, reduces the upward traction effect performed by said needle on the threads 9 and 10.

In this manner, the needles D and E, by encountering the central cam 11, are lowered, and thus engage the threads 9 and 10 which rest correctly on the casting-off planes 4*b* and 4*c* of the sinkers 4.

When the needle cylinder rotates in the opposite direction 14, the movements performed by the cams on the needles are similar to those described above.

In practice it has been observed that the machine according to the invention fully achieves the intended aim, since by virture of the lowering of the needles excluded from knitting at the feed being considered, it reduces or even eliminates the effect of upward traction of the threads fed by said feed, thus allowing the correct forming of loop pile stitches even with very fine knitting and with scarcely elastic threads.

The machine thus conceived is susceptible to numerous modifications and variations, all of which are within the scope of the inventive concept; all the details may furthermore be replaced with technically equivalent elements.

Although the machine according to the invention has been conceived in particular for the knitting of loop pile stitches in sock or stocking manufacture, the concept underlying the invention can be used successfully for other types of knitting as well.

In practice, the materials employed, as well as the dimensions, may be any according to the requirements and to the state of the art.

I claim:

1. Circular knitting machine for socks or stockings, in particular for producing knitting with loop pile stitches, comprising a needle cylinder having a skirt and being activatable with a reciprocatory motion about the needle cylinder axis, a plurality of axial grooves defined on the outer surface of said skirt, each of said grooves slideably accommodating a needle, needle actuation cams facing said skirt of said needle cylinder and defining paths for heels of said needles which protrude radially from said grooves, a plurality of casting-off sinkers being provided, each casting-off sinker being arranged between two contiguous axial grooves of said needle cylinder, proximate to an upper end thereof, said sinkers being radially movable with respect to said needle cylinder to tension loops formed by said needles; said needle actuation cams comprising, upstream of at least one thread feed along the direction of rotation of the needle cylinder about said needle cylinder axis with respect to said needle actuation cams, at least one lifting cam for lifting the needles into a position suitable for gripping at least one thread fed by said thread feed and, successively to said lifting cam, a central cam defining a first descending portion for needles knitting at said feed, wherein immediately above said central cam there is an additional cam defining a descending portion engageable with heels of needles for controlled lowering of loops carried by said needles not knitting during said feed.

2. Machine according to claim 1, wherein upstream of said additional cam, along the direction of rotation of the needle cylinder relatively to said needle actuation cams, there is a lifting cam said lifting cam being engageable with the heel of the needles not knitting at said feed.

3. Machine according to claim 2, wherein said lifting cam is arranged upstream of said lifting cam along the direction of rotation of the needle cylinder relatively to said needle actuation cams.

4. Machine according to claim 1, further comprising at least one casting-off sinker actuation cam defining a path for a sinker heel and extending around the needle cylinder axis, said sinker heel path having at least one portion proximate to the needle cylinder axis, along which said sinkers are positioned to engage loops carried by the needles to tension the loops in the direction of the needle cylinder axis, and a portion spaced from the needle cylinder axis, along which said sinkers are positioned for releasing loops carried by the needles, said portion spaced from the needle cylinder axis being arranged at said thread feed.

5. Machine according to claim 4, wherein said lifting cam is arranged at said portion proximate to the needle cylinder axis in the path defined by the casting-off sinker actuation cams to lift needles not knitting at said thread feed, said sinkers being positioned for engagement with loops carried by said needles not knitting.

6. Machine according to claim 1, wherein each of said sinkers defines two casting-off planes, arranged at different levels, for two threads fed at said feed to form loop pile stitches.

7. Machine according to claim 1, wherein said feed comprises at least two thread guides, a first thread guide having a thread feed end arranged at a higher level with respect to a feed end of a second thread guide.

8. Machine according to claim 1, wherein said additional cam has a symmetric profile defining descending portions, said descending portions being engageable with heels of needles not knitting at said thread feed.

9. Machine according to claim 1, further comprising a further lifting cam arranged downstream of said feed, along the direction of rotation of the needle cylinder relatively to said actuation cams, said lifting cam being engageable with heels of needles not knitting at said thread feed to lift said heels after the lowering performed by said additional cam.

10. Machine according to claim 9, wherein said lifting cam and said further lifting cam have a profile defining ascending portions for heels of needles not knitting at said thread feed in both of the directions of rotation of the needle cylinder.

11. Process for forming loop pile stitches with a circular knitting machines having a cylinder for socks or stockings, comprising the step of knitting a row of knitting with part of the needles not knitting at one feed and raised with respect to the needles knitting at said feed, wherein proximate to said feed the needles not knitting are subjected to a controlled lowering.

12. Process according to claim 11, wherein during said controlled lowering of said needles not knitting at said feed loops carried by the needles not knitting are released from casting-off sinkers.

13. Process according to claim 11, wherein the needles not knitting are subjected to a controlled lifting in a position upstream of said feed along the direction of rotation of the cylinder while loops carried by the needles not knitting are engaged with casting-off sinkers.

* * * * *